US005593020A

United States Patent [19]

Alexander

[11] Patent Number: 5,593,020

[45] Date of Patent: Jan. 14, 1997

[54] APPARATUS FOR LOCKING A CIRCUIT BREAKER, AND METHODS FOR FORMING AND USING SAME

[76] Inventor: Richard L. Alexander, 2106 Longhorn St., Houston, Tex. 77080

[21] Appl. No.: 405,590

[22] Filed: Mar. 7, 1995

[51] Int. Cl.[6] ..... H01H 9/28

[52] U.S. Cl. ..... 200/43.14; 200/43.16; 200/43.15

[58] Field of Search ..... 200/43.11, 43.13, 200/43.14, 43.15, 43.16, 43.18, 43.19, 43.21; 70/DIG. 30

[56] References Cited

U.S. PATENT DOCUMENTS

| | | | |
|---|---|---|---|
| 2,169,860 | 8/1939 | Van Hoorn | 70/203 |
| 2,978,613 | 4/1961 | Hein | 317/119 |
| 3,109,899 | 11/1963 | Pastena | 200/42 |
| 3,408,466 | 10/1968 | Palmer | 200/42 |
| 3,629,529 | 12/1971 | Dietz | 200/42 |
| 3,784,766 | 1/1974 | Johnson | 200/42 |
| 4,006,324 | 2/1977 | Leasher | 200/42 T |
| 4,300,030 | 11/1981 | Dimarco | 200/427 |
| 4,733,029 | 3/1988 | Kobayashi | 200/43.15 |
| 5,122,624 | 6/1992 | Benda | 200/43.14 |
| 5,270,503 | 12/1993 | Frye | 200/43.14 |

*Primary Examiner*—David J. Walczak
*Attorney, Agent, or Firm*—John R. Casperson

[57] ABSTRACT

A safety device for electrical circuit breakers has a base member adapted to be mounted adjacent at least one and preferable a column of circuit breakers. The base member has a plurality of parallel, spaced, transverse grooves. A cover assembly is hingedly attached to one end of the base member and has a like plurality of protrusions depending therefrom, each protrusion aligned to be received in a respective groove of the base member. A plurality of locking pins, each locking pin having an elongated body portion and an integral breaker engaging head, the body portion having a plurality of spaced apart, longitudinally extending, elongated slots, are adapted to be selectively received in the grooves of the body member. The protrusions of the cover assembly are received in respective slots in the locking pins to secure the locking pins in place in the base member.

29 Claims, 7 Drawing Sheets

APPARATUS FOR LOCKING A CIRCUIT BREAKER, AND METHODS FOR FORMING AND USING SAME

BACKGROUND OF THE INVENTION

1. The Field of the Invention

In one aspect, the present invention pertains to a safety device for use with an electrical circuit breaker 2. The Prior Art There has been a continuing increase in concern for safety in industrial settings, such as all phases of manufacturing, in recent years. This concern has prompted the promulgation of many federal and state laws and regulations which are intended to improve occupational safety. In order to comply with those regulations concerning electrical power, it is now required that there must be a way to positively prevent unintentional restoration of electrical power to machinery which is either not operating or is down for service. The clear purpose of these regulations is to prevent serious injuries or death by the inadvertent supply of electrical power to or the starting of machinery which is assumed to be at least temporarily inactive or disabled. At least one of these regulations specifies that machinery be turned off and the power switch be locked in the off position.

There have been a number of devices proposed to fulfill the above discussed ends. Some of these are in the form of flags or tags which are to be placed on the handle of a circuit breaker .which is to be disabled. However, these have the obvious disadvantage of being too easily removed, which could happen through inadvertence and/or oversight, and create an unintended dangerous situation. Another popular solution to this need involves rods and/or bars which pass through or engage apertures in the handles of circuit breakers. These types of solutions have the obvious disadvantage of requiring a certain type of circuit breaker, namely one with an appropriately sized and directed hole in the handle, in order to function. Use of such devices might prove to be extremely expensive in requiring either replacement of circuit breakers with one having appropriate handles or boring holes in the handle of the existing breakers. This latter case would require dismounting of the circuit breaker from the box and circuit in order to safely perform the boring operation. A further approach to the problem is to have a device which is adapted to be mounted adjacent a column of circuit breakers with circuit breaker engaging pins selectively mounted therein to engage and disable the selected circuit breaker.

OBJECTS OF THE INVENTION

It is an object of this invention to provide a safety device which provides positive locking of a wide variety of circuit breakers.

It is another object of this invention to provide a safety device which can accommodate a wide variety of breaker designs with minimal modification.

It is a further object of this invention to provide a safety device which which is easy and quick to install.

It is a further object of this invention to provide a safety device system which is simple and easy to use and release.

It is a further object of this invention to provide a safety device which accomplishes the foregoing objects economically.

SUMMARY OF THE INVENTION

In one embodiment of the invention, a circuit breaker safety device has an elongated base member and a cover assembly hingedly attached to one end of the base member. The base member has a plurality of parallel, spaced, transverse grooves. The cover assembly has a like plurality of parallel spaced protrusions depending therefrom, each protrusion aligned with in a respective groove of the base member. The invention may be used in conjunction with a plurality of locking pins each adapted to be received in the base member so as to extend transversely therefrom, and means to latch the cover assembly closed so as to secure the locking pins in place in the base member. Preferably, each of the plurality of locking pins has an elongated body portion and an integral circuit breaker engaging head. The body portion of each locking pin has a plurality of spaced apart, cavities. The protrusions of the cover assembly are received in the slots to lock the locking pin in place against movement along its longitudinal axis.

The subject circuit breaker safety device can be mounted adjacent to at least one conventional circuit breaker. It can be provided with a low profile which allows it to be installed inside a circuit breaker panel and still close the panel cover. None of the circuit breakers used with the present invention require any type of modification.

In another embodiment of the invention, there is provided a method for locking a breaker switch mounted on a breaker panel. The panel has a generally planar panel face. The breaker switch is movable in a breaker switch plane. The method involves positioning a locking pin against the breaker switch to immobilize the switch, usually in the off position. The locking pin is positioned in the breaker switch plane and parallel to the generally planar panel face. The locking pin has an elongated body portion which defines a cavity. The locking pin is positioned in a circuit breaker safety device having a locking pin receiving groove. The circuit breaker safety device also has a cover assembly which has a protrusion that can be engaged with the cavity in the locking pin when the cover plate is in a closed position. The protrusion of the cover assembly is positioned in the cavity in the locking pin to lock the breaker switch.

The present invention is modular and readily cut to length or linked together in the field by the installing technician to the desired length and/or configuration. In another embodiment of the invention, there is provided a method for forming a circuit breaker safety device. An elongated base member is provided and cut to fit adjacent to a circuit breaker column. A cover plate is provided and cut to fit alongside the elongated base member. The cover plate is then fastened to the base member. Then a latching assembly is fastened to the other end of the base member. For use, the base member is fastened adjacent to a column of circuit breakers.

BRIEF DESCRIPTION OF THE DRAWINGS

The present invention will now be described, by way of example, with reference to the accompanying drawings in which.

DETAILED DESCRIPTION OF THE PREFERRED EMBODIMENTS

Figure 1:
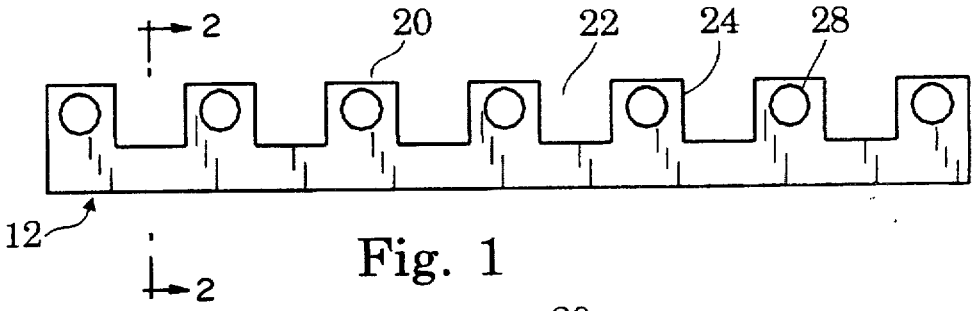
FIG. 1 is a side view of the base member of the present invention.
Figure 2:
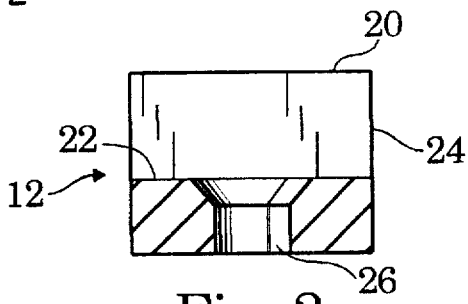
FIG. 2 is a transverse section taken along line 2—2 of FIG. 1.
Figure 3:
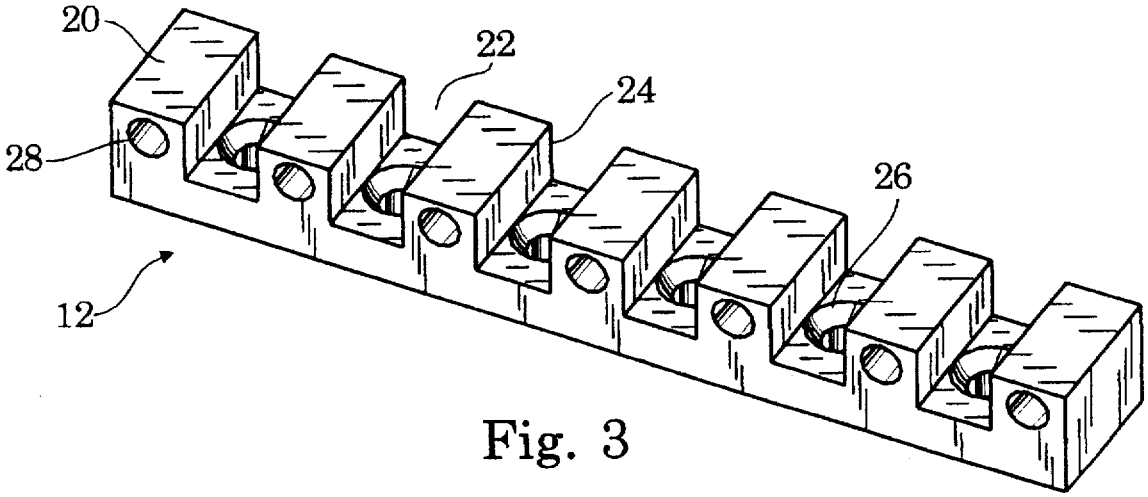
FIG. 3 is a perspective view of the base member of FIG. 1.
Figure 4:
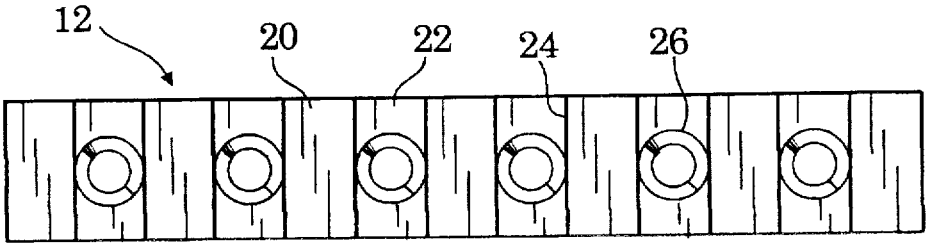
FIG. 4 is a top plan of the base member of FIG. 1.
Figure 1A:
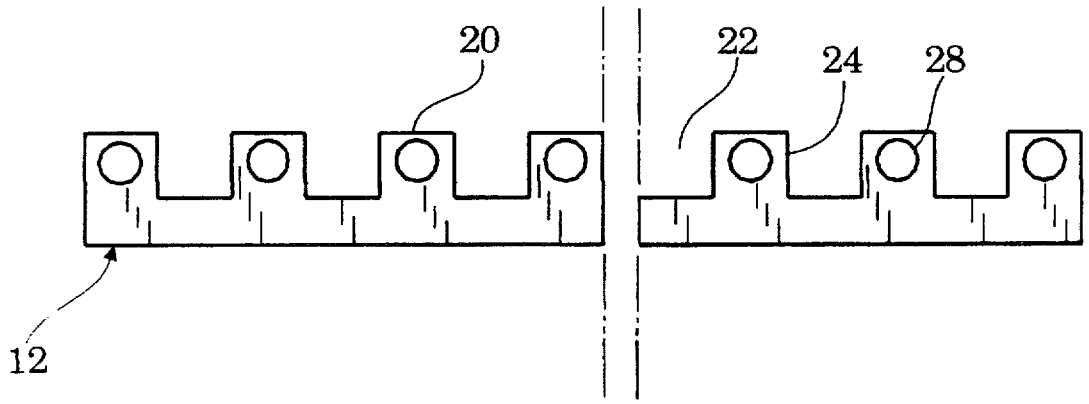
Figure 5:
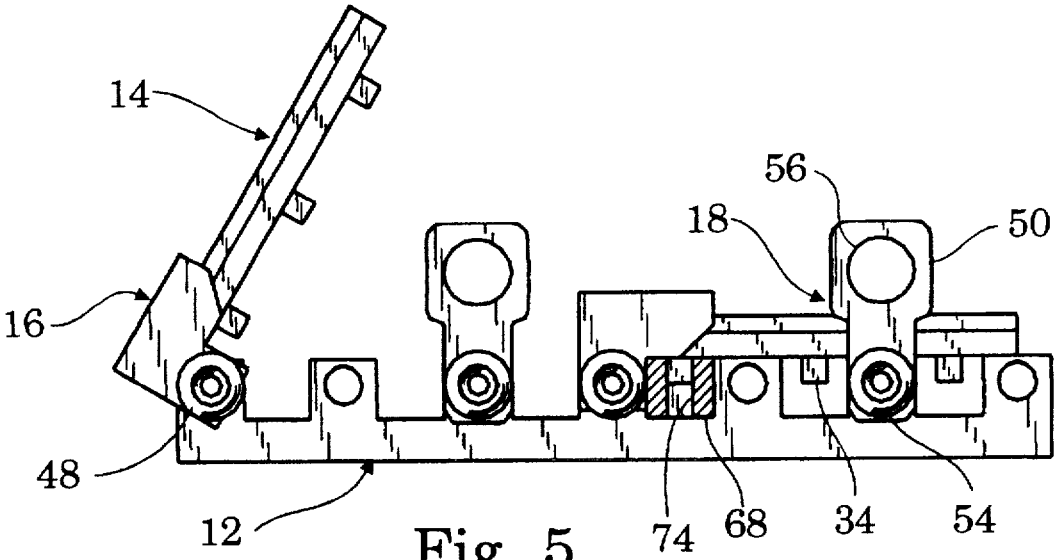
FIG. 5 is a side elevation of the circuit breaker safety device according to one embodiment of the present invention.
Figure 6:
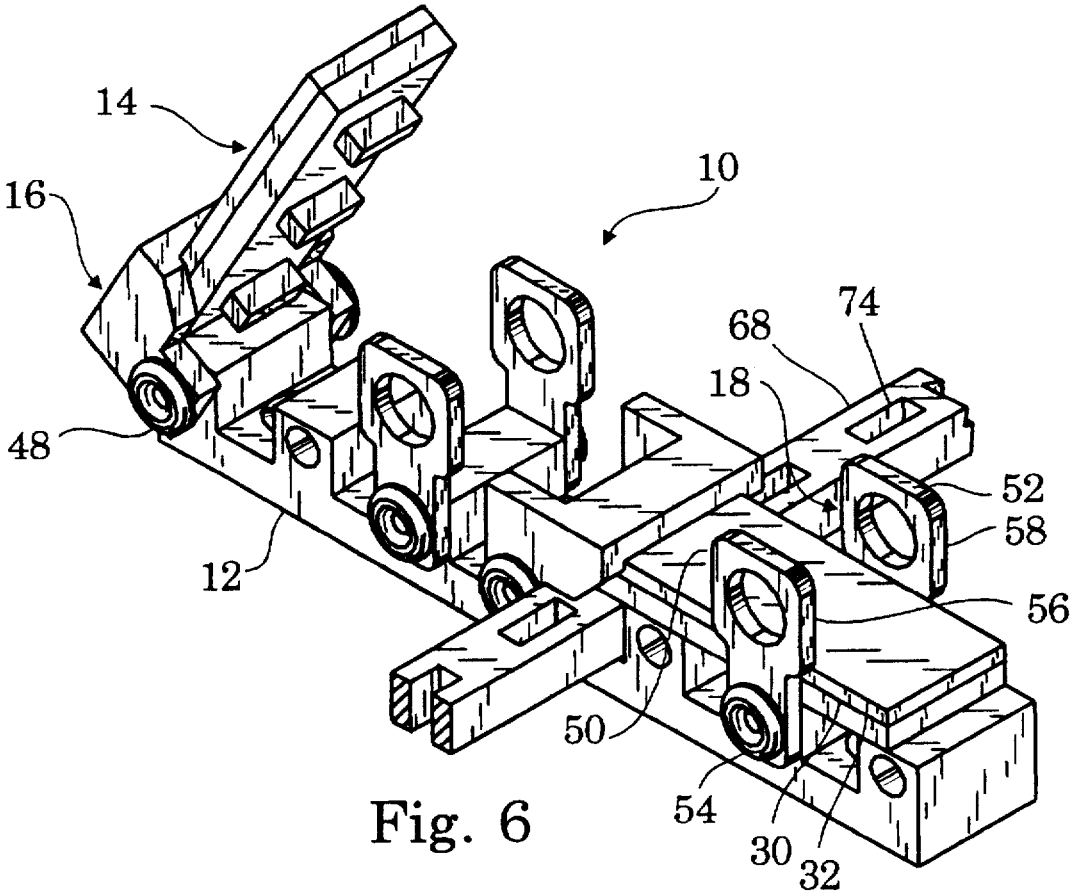
FIG. 6 is a perspective view of the circuit breaker safety device of FIG. 5.

The circuit breaker safety device 10, according to the present invention, can best be understood from the perspective view of FIG. 6 as having a elongated base member 12, and a cover assembly 14.

The base member 12 (see FIGS. 1 to 4) is preferably an elongated solid block which is generally rectangular in section and overall appearance. An upper face 20 of the member 12 is intersected by a plurality of parallel spaced transverse grooves 22 defining a plurality of generally uniform preferably rectangular teeth 24. This embodiment shows a profiled through bore 26 formed in the base of at least some of the grooves 22 normal to the upper face 20. A transverse bore is preferably provided at least near the first end and the second end of the elongated base member. In the illustrated embodiment, a transverse bore 28 is preferably formed through at least some of the teeth 24. The transverse bore is parallel to the upper face 20. The base member 12 preferably has a length to match that of a vertical column of circuit breakers and some of the grooves 22 are preferably aligned with the circuit breakers in the column, regardless of the distance between breakers. If desired, one or more base members can be positioned alongside the column, to achieve the desired length and/or configuration. The subject invention can also be utilized with an individual circuit breaker or switch.

In a preferred embodiment, the cover assembly 14 (see FIGS. 5, 6 and 13 to 15) comprises a lock plate 30 and a cover plate 32. The lock plate 30 has a plurality of parallel, spaced, transverse protrusions 34 depending from the bottom face 36 thereof. In this embodiment the protrusions are shown formed by lances struck from the plate 38. Each protrusion 34 is spaced and aligned to be received in a respective groove 22 of the base member 12. The cover plate 32 is secured to the back face 38 of the lock plate 30. The cover plate can be provided with circuit identity and/or regulation identify strips or tags (not shown). The cover plate 32 could be formed with a pocket or lateral edge grooves (neither of which has been shown) for receiving the tags therein in known fashion.

Figure 10:
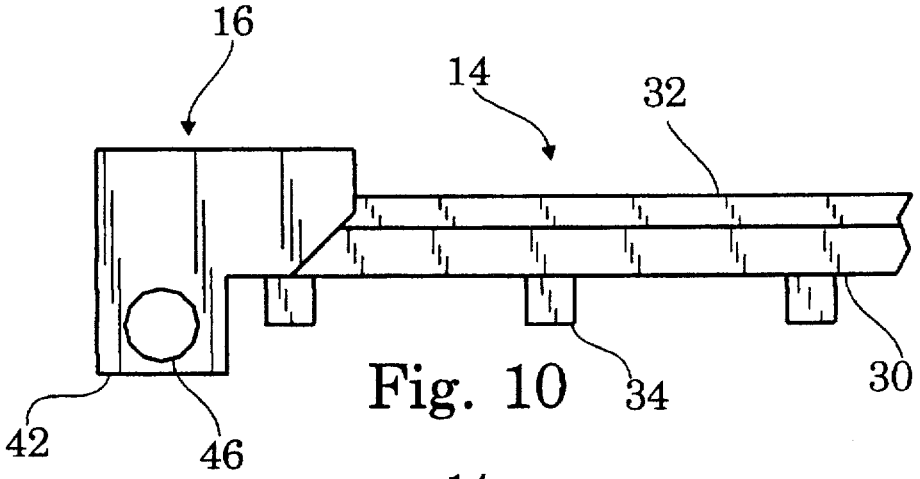
FIGS. 10 to 12 are a side, top plan, and perspective view, respectively, of the hinge member according to one embodiment of the present invention.
Figure 11:
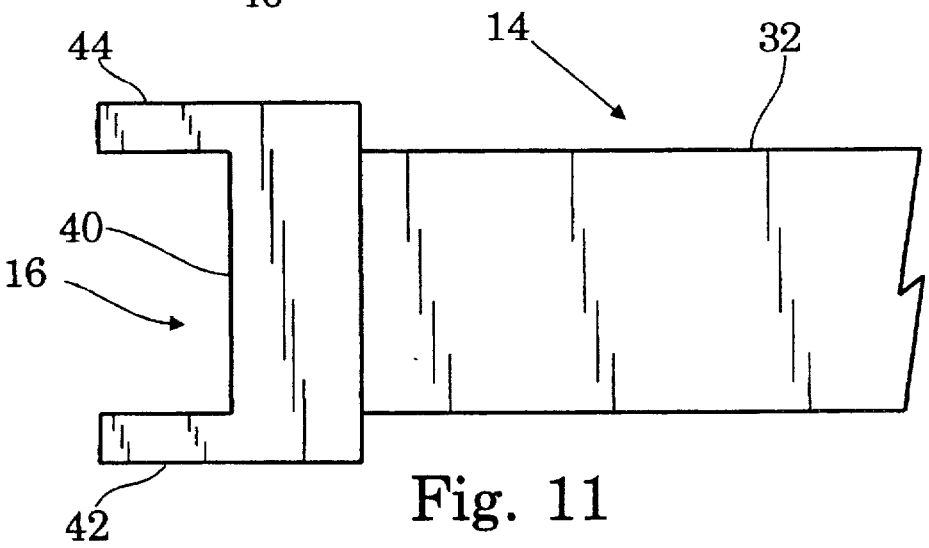
Figure 12:
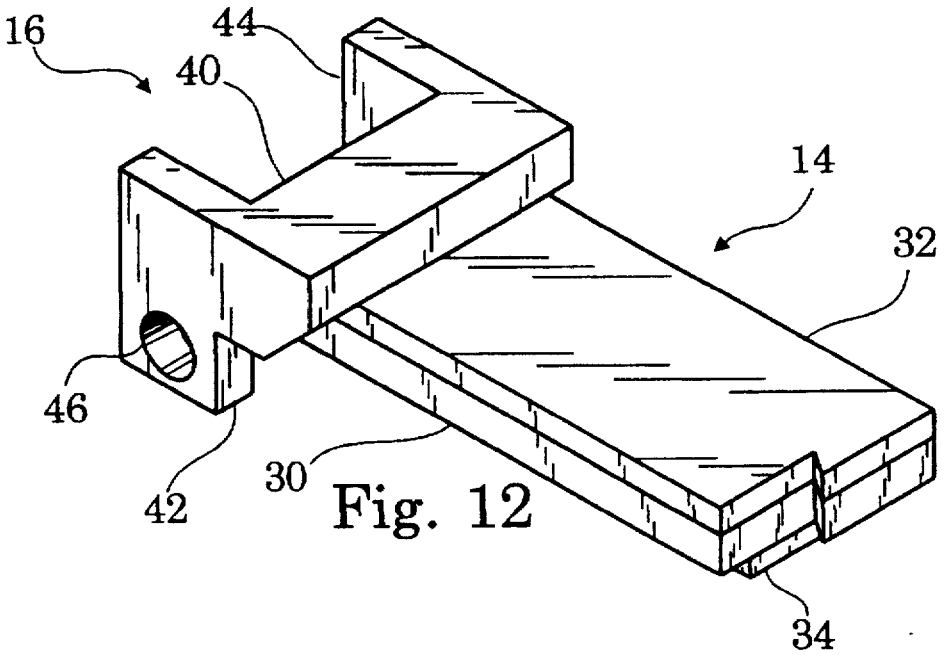
Figure 13:
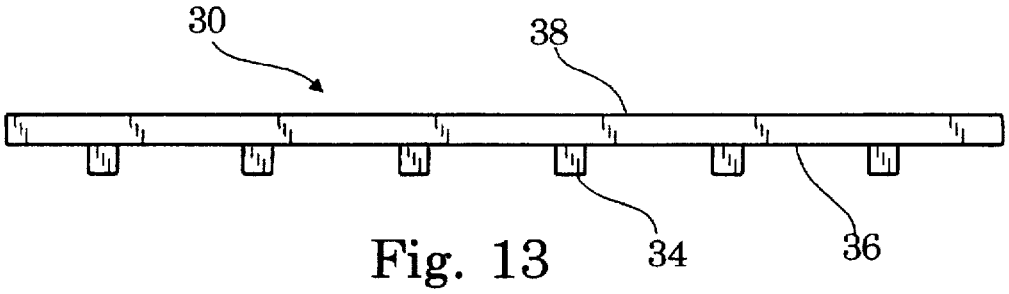
FIGS. 13 to 15 are a side, bottom plan, and longitudinal section through the lock plate portion of the cover assembly of one embodiment of the present invention.
Figure 14:
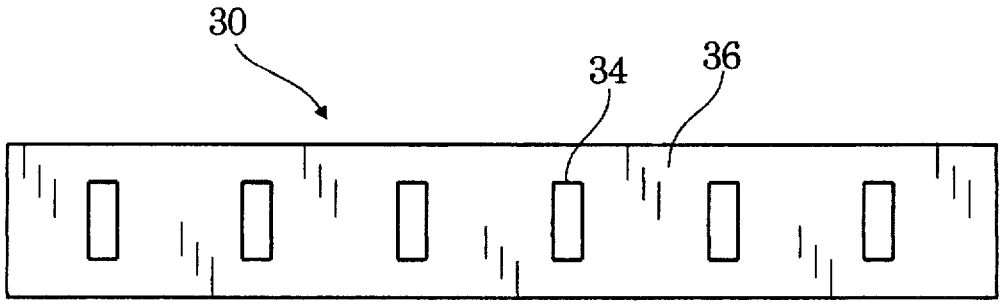
Figure 15:
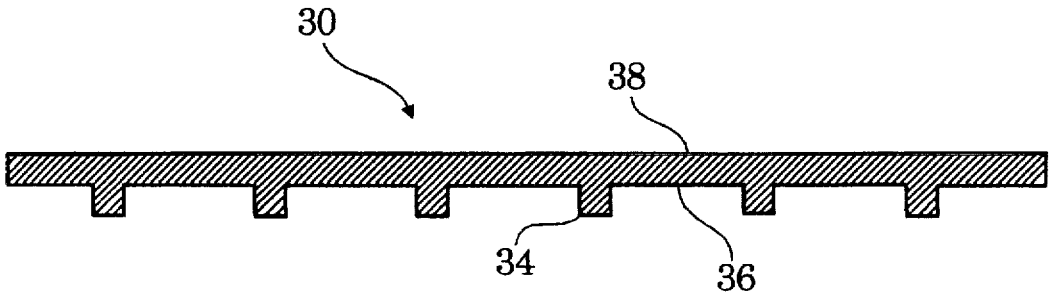
Figure 16:
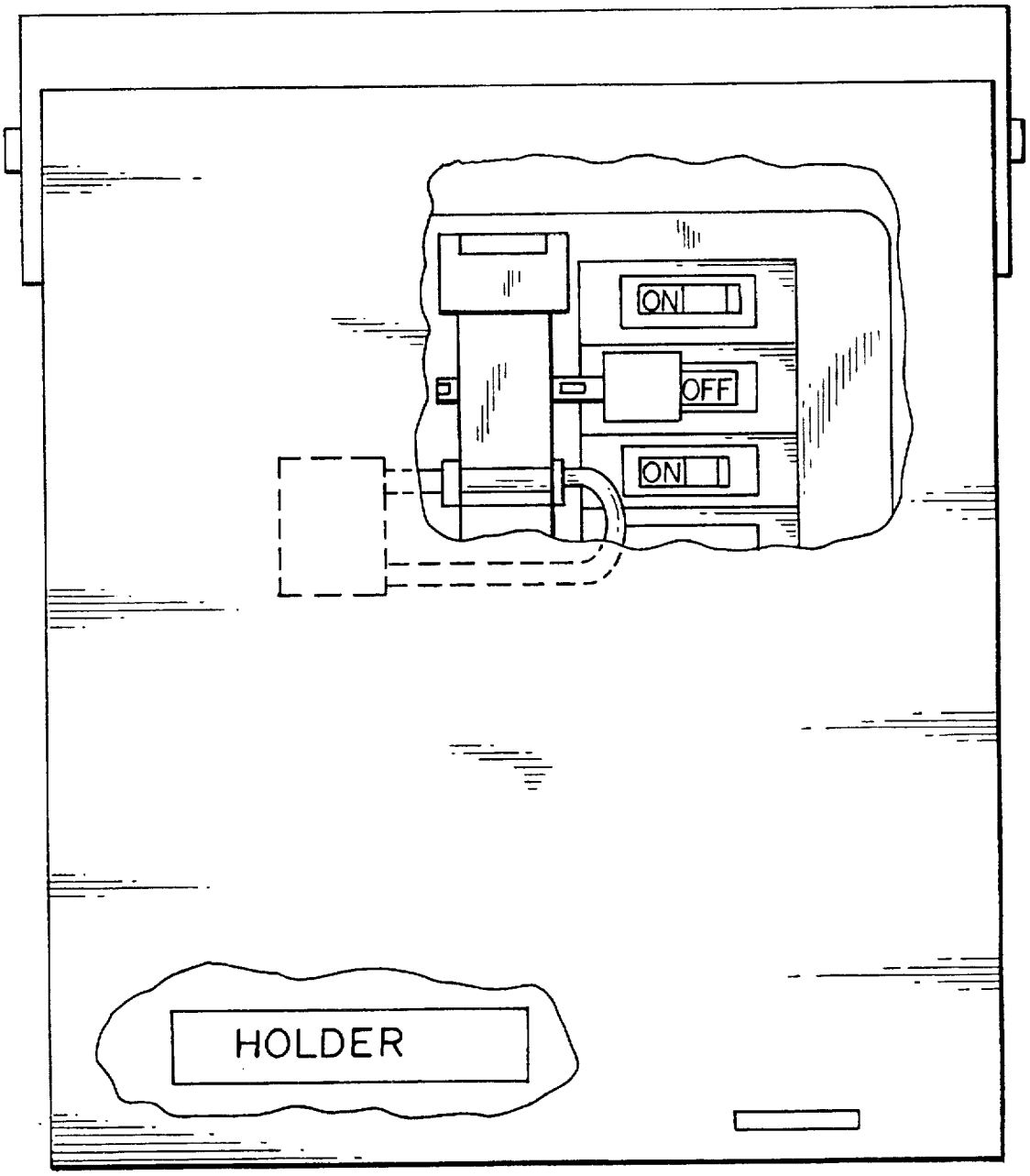
FIG. 16 schematically illustrates a breaker panel door having a first portion broken away to show a circuit breaker panel having a column of circuit breakers with a circuit breaker safety device mounted alongside the column and a second portion broken away to show schematically a locking pin holder attached to the breaker panel.

Preferably, the cover assembly 14 is provided with a hinge means at one end thereof. In the illustrated embodiment, the hinge means comprises a hinge member 16 (see FIGS. 10 to 12). The hinge member 16 is formed with a central web 40 and a pair of spaced integral side walls 42, 44, depending from opposite sides thereof. Each side wall is provided with aligned bores 46 which will align with a respective transverse bore 28 in the base member 12 to receive a hinge pin 48 therethrough. The cover assembly 14 is attached to the center web 40 of the hinge member 16. Spot welding or any other known attachment means is believed suitable.

Preferably, the apparatus is provided with a latching means spaced apart from the hinge means. In the illustrated embodiment, a latching means 18 is rotatably mounted towards the other end of the base member 12 and is formed by a pair of like plates 50, 52 and rod means 54. The rod means 54 passes through a transverse bore 28 in the base member spaced from the hinge member 16. The plates 50, 52 each have aligned bores 56, 58 sized so that locking means (not shown) can be passed through the bores securing the cover assembly 14 in a closed condition against the base member 12. A padlock will provide good results. Preferably, the hasp of the locking means is closely sized to fit the bores, or the locking means comprises a pin which is placed through the bores and the pin is padlocked in place.

Figure 7:
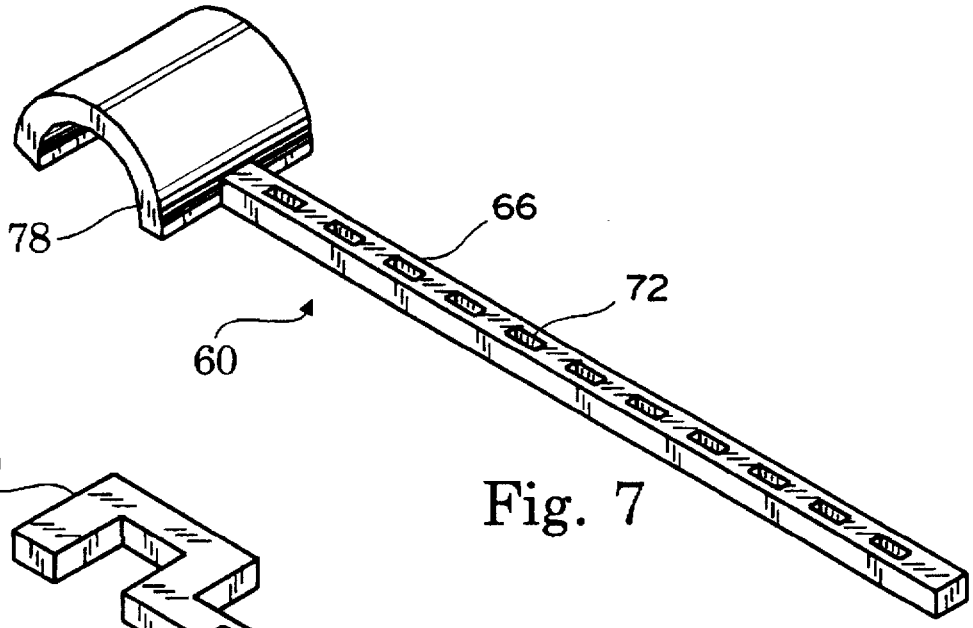
FIGS. 7 to 9 are perspective views of three different embodiments of locking pins suitable for use in the present invention.
Figure 8:
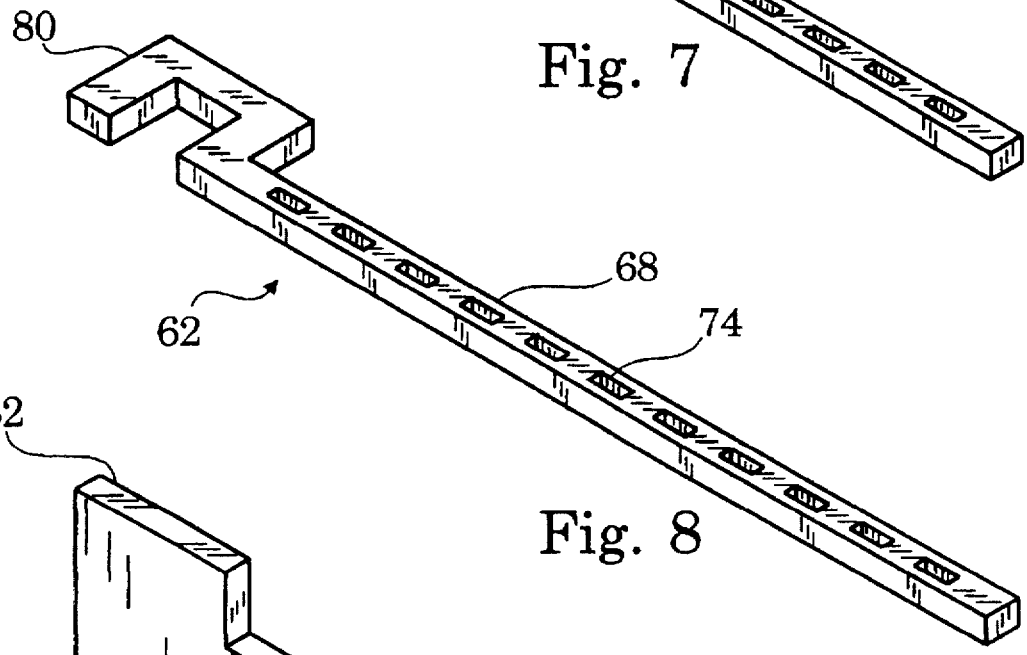
Figure 9:
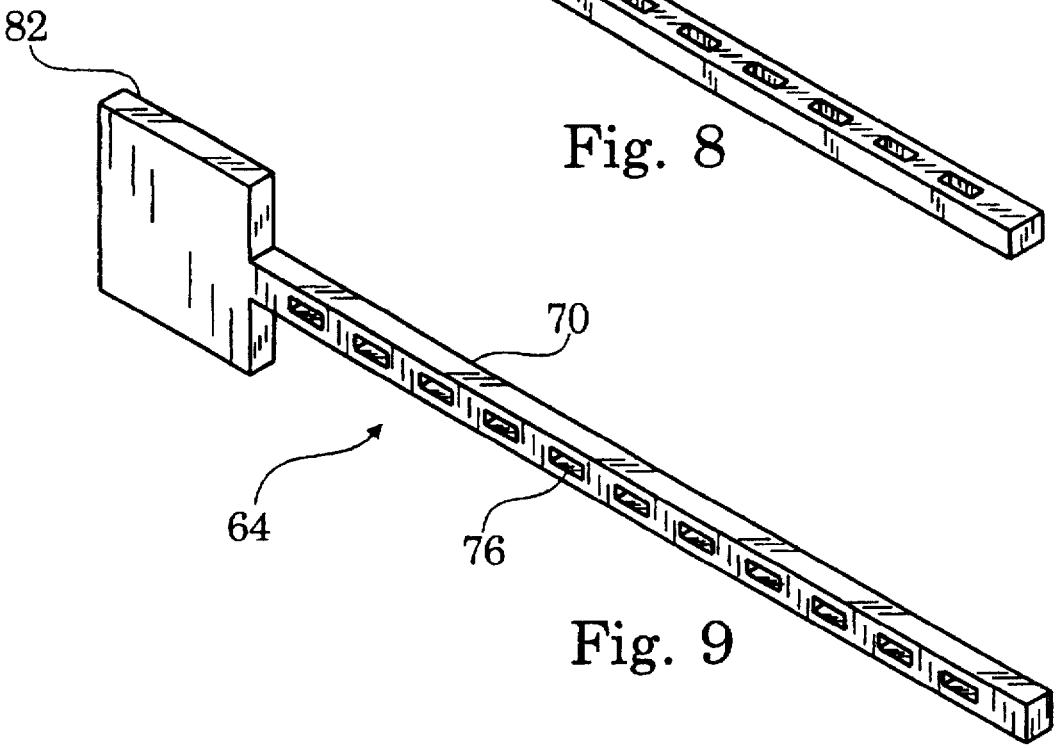

Three different locking pins have been shown in FIGS. 7 to 9. Many other suitable single end and double end locking pins with various end profiles or a combination of end profiles could be provided. The locking pins can also be employed without headed ends..The primary feature of each of the three illustrated locking pins 60, 62, 64 is an elongated body portion 66, 68, 70. Preferably, the body portion is formed from a bar of substantially rectangular section. Each body portion is provided with a plurality of spaced cavities preferably in the form of slots or grooves 72, 74, 76 extending longitudinally therealong in aligned spaced relationship. Preferably, each cavity comprises a passage extending through the body portion of the locking pin to provide a convenient site for affixing a lockout tag. One end of each locking pin has been shown provided with, respectively, a semi-cylindrical head 78 the axis of which is transverse to the longitudinal axis of the bar 66, a rectangular hook head 80 in the plane of the bar 68 and opening in a direction transverse to the longitudinal axis of the bar, and a rectangular plate head 82 lying in the plane of the bar 70. The bar portions of the locking pins are preferably sized for close fitting reception in the grooves 22 of the base member 12 which are of like shape. The slots are likewise sized to receive the protrusions 34 therein and are preferably of like shape. Locking pins 60 and 62 would be suitable for use with a circuit breaker or switch having a lever reset means. Locking pins 60 and 64 could be used for circuit breakers or switches having push button reset means. As mentioned previously, any of the three locking pins shown could be profiled on both ends with like or a combination of profiles. The bar portions preferably are of sufficient length to allow the locking pin to engage a circuit breaker or switch reasonably spaced therefrom and can be trimmed in the field to such length as to prevent interference with adjacent circuit breakers and/or switches. Preferably, the spacing between the grooves is equal to the spacing between the breaker switches, although selection of a wide locking pin head design and/or locking pin modification in the field can be used to accommodate misalignments.

The subject device can be mounted on or adjacent to a circuit breaker or switch in a number of different ways. For example, the base member of FIGS. 1 to 4 is shown with a profiled through bore 26 between each of the teeth 24. Flat head screws (not shown) could be passed through these bores and driven into the circuit breaker box or the mounting adjacent thereto. Alternatively, the circuit breaker box could be provided with spaced and aligned studs (also not shown) the ends of which are received through bores 26 in the base member and secured thereto by non-reversing push pin clips (also not shown) of known design. The studs would preferably be welded to the circuit breaker box or mounting. It would also be possible to mount the subject invention using any of the well known adhesives which are commercially available.

The present invention would be mounted in alignment with a circuit breaker in any of the above described fashions. The subject circuit breaker safety device 10 would be positioned with the grooves 22 of the base member 12 substantially aligned with the handles, levers or reset buttons of corresponding circuit breakers. In order to lock the position (set condition) of any circuit breaker or combination of circuit breakers, the lock would be removed from the latching means 18, the cover assembly 14 raised, and an appropriate locking pin 60, 62, 64 selected for insertion into a groove 22 in substantial alignment with the circuit breaker in point. The selected locking pin would be adjusted for the correct length, if necessary, and inserted into the selected groove in alignment with the circuit breaker to be disabled. The locking pin, using pin 62 as an example, would be placed with the elongated body 68 in the groove 22 so that a slot 74 is aligned to receive a protrusion 34 of the cover assembly 14 therein. The head 80 of the locking pin 62 which is preferably an integral circuit breaker engaging head, would be positioned for engaging a respective handle or lever of the circuit breaker in such fashion as to prevent the actuation (movement) thereof. If the circuit breaker is of the push button type, then a locking pin 60 or 64 would be selected and positioned with the semi-cylinder 78 or plate 82 overlying the circuit breaker in such fashion as to prevent actuation of the push button(s).

In a typical embodiment the base member would be manufactured in sufficient modular lengths to protect one or a plurality of circuit breakers. Since the design of the subject invention is substantially continuous, it is readily field modified should a short device be needed and only a longer one available on site. In this case the base member would be cut through at a selected groove to the desired length, for example to provide a base member having four to a dozen transverse grooves in parallel spaced relation along the upper face thereof. Regardless of the selected length, in a preferred embodiment, at least two of the grooves should have centrally located countersunk mounting bores therein. The cover assembly would be formed in similar fashion, in lengths appropriate for the base member it is to be mounted on. One of the cover assembly plates is provided with a plurality parallel spaced protrusions which can be formed, for example, by punches forming lances extending substantially perpendicular to the bottom face thereof so as to be aligned to be received in respective transverse grooves of the base member.

The locking pins of FIGS. 7 to 9 are each shown with a single profiled end. These embodiments could easily be cut to length, should there not be adequate room for the unneeded portion of the bars 72, 74, 76. In the alternative, a locking pin could be made double ended by having a bar of fixed length with the same or different profiles on the opposite ends thereof. Such a locking pin would be placed to simultaneously engage a pair of circuit breakers, each spaced from an opposite side of the subject device.

The subject circuit breaker safety device can be selectively attached to a circuit breaker box, panel or mounting by substantially any accepted method, such as standard screws; studs welded to the box or panel and the safety device secured thereto by passing the studs through the device and placing on the studs non-reversing friction push pin requiring substantial force, i.e. greater that 50 pounds, to override; or by adhesives.

The subject circuit breaker safety device provides for positively locking circuit breakers and/or switches in a manner that conforms to the most severe regulatory commission requirements for strength, visual assurance, simplicity of installation and training, and ease of selection and use, while providing the most dependable safety possible. The present circuit breaker safety device can be used, not only for locking off (out) circuits, but also for locking on circuits that might be safety, security, or conservation oriented.

The subject circuit breaker safety device has a low overall profile that allows the door of a circuit breaker box or panel to be closed when locking system is in use. It is also readily field adaptable for columns of circuit breakers of various lengths. Most importantly, the subject safety device can be used with circuit breakers or switches which have either lever or push button reset means.

Standard selection and measurement techniques can be used with the present invention for selection of the proper safety device for a panel or breaker size up to 480 v and 600 amps. The present invention does not compromise state or national safety codes and regulations and can provide warning notice for each panel to provide assistance in operation. These notices can be used for surveying, identifying, and recording all circuits and their use.

In another embodiment of the invention, there is provided a method for locking a breaker switch mounted on a breaker panel. The panel has a generally planar panel face. The breaker switch is movable in a breaker switch plane, preferably including those switches that move pivotally. The method involves positioning a locking pin against the breaker switch to immobilize the switch usually in the off position. The locking pin is positioned in the breaker switch plane and parallel to the generally planar panel face. The locking pin has an elongated body portion which defines a cavity. The locking pin is positioned in a circuit breaker safety device having a locking pin receiving groove. The circuit breaker safety device also contains a cover assembly which has a protrusion that can be engaged with the cavity in the locking pin when the cover plate is in a closed position. The protrusion of the cover assembly is positioned in the cavity in the locking pin to lock the breaker switch.

In a another embodiment of the invention there is provided a method which involves providing a circuit breaker safety device with an elongated base member that is adapted to be mounted adjacent to the circuit breaker switch to be locked. The base member has a plurality of parallel spaced transverse locking pin receiving grooves. The cover assembly is attached by a hinge to one end of the base member. The cover assembly has a like plurality of protrusions that engage with the cavity in the locking pin. These protrusions are aligned to be received in a respective groove of the base member. There is a latching means mounted on the base member spaced from the hinge and adapted to engage the cover assembly in a closed position.

A plurality of locking pins are provided, each having an elongated body portion and an integral circuit breaker engaging head. In a preferred embodiment, the locking pins are stored in a locking pin holder which is also attached to the breaker panel inside of the door. The cavity in the locking pin is defined by one of a plurality of spaced apart, elongated, longitudinally extending slots in the body portion. A locking pin is selected and positioned in one of the transverse grooves in the base member. The locking pin extends laterally from the base member with the head immobilizing the switch in the off position. The cover assembly is then closed so that one of the plurality of protrusions is received in a slot of the locking pin to secure the locking pin in the circuit breaker safety device against substantially any movement. Finally, a locking means is placed on the latching means to secure the cover assembly and the latching means in a closed position. The circuit breaker safety device is preferably sized such that a breaker panel door, where provided, may be opened and closed easily when the latching means is not in use.

In still another embodiment of the invention, there is provided a method for safely and positively selectively controlling at least one circuit breaker of known configuration. This method entails mounting an elongated base member adjacent to the circuit breaker to be controlled. The base member has a plurality of parallel spaced transverse grooves. The method further providing a cover assembly attached by a hinge to one end of the base member. The cover assembly has a like plurality of protrusions each aligned to be received in a respective groove of the base member.

A plurality of locking pins, each having an elongated body portion and an integral circuit breaker engaging head are provided. The body portion has a plurality of spaced apart, elongated, longitudinally extending slots. A locking pin is selected from the plurality of locking pins and placed in one of the grooves in the base member. The locking pin extends laterally from the base member with the circuit breaker engaging head thereof positioned to prevent actuation of the circuit breaker. The cover assembly is closed so that one of the protrusions is received in the slots of the respective locking pins to secure each locking pin in the safety device against substantially any movement.

In a further preferred embodiment of the invention, there is provided a latching means mounted on the elongated base member spaced from the hinge member. The latching means is adapted to engage the cover assembly in a closed position. A locking means is placed on the latching means to secure the cover assembly and the latching means in a closed position.

In still another embodiment of the invention, there is provided a method for forming a circuit breaker safety device. An elongated base member is provided and cut to fit adjacent to a circuit breaker column. A cover plate is provided and cut to fit alongside the elongated base member. The cover plate is then fastened to the base member. Then a latching assembly is fastened to the other end of the base member. For use, the base member is fastened adjacent to a column of circuit breakers.

In a preferred embodiment, the elongated base member has a plurality of locking pin receiving grooves. The cover plate has a plurality of protrusions. The protrusions of the cover plate are spaced apart to match the grooves of the elongated base member. Additionally, the cover plate is fastened to the base member so that the cover plate is movable from an open position to a closed position. The cover plate is positioned so that the protrusions on the cover plate are aligned with the grooves in the base member when the cover plate is in the closed position.

The present invention may be subject to many modifications and changes without departing from the spirit or essential characteristics thereof. The present embodiment should therefor be considered in all respects as illustrative and not restrictive of the scope of the present invention as defined by the appended claims.

I claim:

1. A circuit breaker safety device comprising:

an elongated base member having a first end and a second end and adapted to be mounted adjacent a column of circuit breakers, said elongated base member having a plurality of parallel spaced transverse grooves; and a cover assembly having a first end and a second end hingedly attached by the first end to the elongated base member and having a plurality of transversely extending protrusions, said cover assembly being movable from an open position to a closed position, each protrusion being aligned to be received by a groove of said elongated base member when the cover assembly is in the closed position.

2. A circuit breaker safety device according to claim 1, wherein the first end of the cover assembly is hingedly attached to the first end of the elongated base member, said circuit breaker safety device further comprising a latching means mounted towards the second end of said elongated base member and adapted for receiving a locking means to engage and latch the cover assembly in a closed condition.

3. A circuit breaker safety device according to claim 2 wherein said plurality of spaced transverse grooves define a plurality of teeth therebetween.

4. A circuit breaker safety device as in claim 3 wherein a transverse bore extends through the elongated base member near the first end thereof.

5. A circuit breaker safety device according to claim 4 wherein the cover assembly further comprises:

a hinge member positioned at the first end of the cover assembly, said hinge member having a first side wall and a second side wall, and a central web connecting said first side wall and second side wall, said first side wall and said second side wall defining a pair of aligned apertures; and a hinge pin means positioned in the transverse bore of the elongated base member and extending through the aligned apertures to hingedly connect the cover assembly to the elongated base member.

6. A circuit breaker safety device according to claim 3 wherein at least one tooth of said plurality of teeth has a transverse bore extending therethrough.

7. A circuit breaker safety device as in claim 3 wherein each tooth of the plurality of teeth has a transverse bore extending therethrough.

8. A circuit breaker safety device according to claim 3 wherein a transverse bore extends through the elongated base member near the second end thereof.

9. A circuit breaker safety device as in claim 8 wherein the latching means comprises a first plate and a second plate, each of said first plate and said second plate being pivotally connected to the elongated base member by a rod means received by the transverse bore extending through the elongated base member near the second end thereof, each of said first plate and said second plate defining an aperture, the apertures of said first plate and said second plate together defining a pair of aligned bores for receipt of a locking means.

10. A circuit breaker safety device according to claim 1 wherein said cover assembly comprises a first plate member having a first face and a second face and said plurality of transversely extending protrusions depend substantially normal to the first face of the first plate member.

11. A circuit breaker safety device according to claim 10 further comprising a second plate member secured to the second face of the first plate member to provide a surface for identity indicia.

12. A circuit breaker safety device according the claim 10 wherein said plurality of transversely extending protrusions comprises lances formed by a stamping technique.

13. A circuit breaker safety device comprising:

an elongated base member having a first end and a second end and adapted to be mounted adjacent a column of circuit breakers, said elongated base member having a plurality of parallel spaced transverse grooves;

a cover assembly having a first end and a second end hingedly attached by the first end to the elongated base member and having a plurality of transversely extending protrusions, said cover assembly being movable from an open position to a closed position, each protrusion being aligned to be received by a groove of said elongated base member when the cover assembly is in the closed position; and a locking pin comprising an elongated body portion having a first end and a second end, said elongated body portion having a plurality of spaced apart cavities, wherein said locking pin is received in and extends from one of the plurality of parallel spaced transverse grooves in the elongated base member with one of the plurality of transversely extending protrusions of the cover assembly being received in one of the plurality of spaced apart cavities of the locking pin to secure the locking pin in the circuit breaker safety device against substantially any movement when the cover assembly is in the closed position.

14. A circuit breaker safety device as in claim 13 wherein the cavities of the locking pin and the protrusions of the cover assembly are sized such that the cavities of the locking pin closely receive the protrusions of the cover assembly.

15. A circuit breaker safety device as in claim 13 wherein the locking pin has an integral circuit breaker engaging head on the first end of the elongated body portion.

16. A circuit breaker safety device according to claim 15 wherein the integral circuit breaker engaging head has a rectangular plate shape to engage a circuit breaker so as to prevent the movement thereof.

17. A circuit breaker safety device according to claim 15 wherein the integral circuit breaker engaging head is hook shaped to embrace a switch lever of a circuit breaker so as to prevent the movement thereof.

18. A circuit breaker safety device according to claim 15 wherein the integral circuit breaker engaging head is semi-cylindrical in shape to substantially enclose a switch lever of a circuit breaker so as to prevent the actuation thereof.

19. A circuit breaker safety device according to claim 18 wherein the longitudinal axis of said semi-cylindrical head extends transverse to the longitudinal axis of the elongated body portion of said locking pin.

20. A circuit breaker safety device according to claim 13 wherein said elongated body portion of said locking pin is rectangular in longitudinal and transverse section and is sized to be closely received in one of said plurality of parallel spaced transverse grooves of said elongated base member and the cavities are in the form of a plurality of spaced apart, longitudinally extending, elongated slots.

21. A method for locking a breaker switch mounted on a breaker panel having a generally planar panel face, said breaker switch being movable in a breaker switch plane, said method comprising:

positioning a locking pin in a position against the breaker switch to immobilize the breaker switch, said locking pin being positioned in the breaker switch plane and parallel to the generally planar panel face, said locking pin having an elongated body portion which defines a cavity;

positioning the locking pin in a circuit breaker safety device having a locking pin receiving groove and a cover assembly having a protrusion engageable with the cavity in the locking pin when the cover plate is in a closed position, and positioning the protrusion of the cover assembly in the cavity in the locking pin to lock the breaker switch.

22. A method for locking a breaker switch as in claim 21 wherein the breaker switch moves pivotally in the breaker switch plane and the breaker switch is immobilized in the off position.

23. A method as in claim 21 further comprising:

providing a circuit breaker safety device comprising:

an elongated base member adapted to be mounted adjacent to the breaker switch to be locked, said elongated base member having a first end and a second end and a plurality of parallel spaced transverse locking pin receiving grooves;

a cover assembly having a plurality of protrusions engageable with the cavity in the locking pin and aligned with a respective groove of said elongated base member;

a hinge means mounted on the elongated base member hingedly connecting the cover assembly to the base member; and a latching means mounted on said elongated base member spaced from said hinge means and adapted to engage the cover assembly in a closed position;

providing a plurality of locking pins, each having an elongated body portion and an integral circuit breaker engaging head, wherein the cavity in the locking pin is defined by one of a plurality of spaced apart, elongated, longitudinally extending slots in the body portion;

selecting a locking pin from said plurality of locking pins;

positioning the locking pin in one of said transverse grooves in the elongated base member to extend laterally therefrom with the head thereof being positioned to immobilize the breaker switch;

closing the cover assembly so that one of said plurality of protrusions thereof is received in a slot of the selected locking pin to secure said locking pin in the circuit breaker safety device against substantially any movement; and placing a locking means on the latching means to secure said cover assembly and said latching means in a closed position.

24. A method as in claim 21 further comprising:

providing a breaker panel door to cover the breaker panel, said door being positionable in an open position and a closed position;

providing a locking pin holder attached to the breaker panel, wherein the plurality of locking pins are stored in the locking pin holder and the locking pin is selected from the locking pin holder;

positioning the breaker panel door in the closed position when the latching means is not in use.

25. A method for safely and positively selectively controlling at least one circuit breaker of known configuration comprising the steps of:

providing an elongated base member mounted adjacent the circuit breaker to be controlled, said elongated base member having a plurality of parallel spaced transverse grooves;

providing a cover assembly hingedly attached to one end of the elongated base member and having a like plurality of protrusions each aligned to be received in a respective groove of said elongated base member;

providing a plurality of locking pins, each having an elongated body portion and an integral circuit breaker engaging head, said elongated body portion having a plurality of spaced apart, elongated, longitudinally extending slots;

selecting one locking pin from said plurality of locking pins and placing said locking pin in one of said transverse grooves in the elongated base member to extend laterally therefrom with the circuit breaker engaging head thereof positioned to prevent actuation of said circuit breaker; and closing the cover assembly so that one of the plurality of protrusions thereof is received in one of the longitudinally extending slots of a locking pin to secure said locking pin in the safety device against substantially any movement.

26. A method as in claim 25 further comprising:

providing a latching means mounted on said elongated base member spaced from said hinge member and adapted to engage the cover assembly in a closed position; and placing a locking means on the latching means to secure said cover assembly and said latching means in a closed position.

27. A method comprising:

providing an elongated base member having a first end and a second end and at least one groove therein;

cutting said elongated base member to fit adjacent to a circuit breaker column;

providing a cover plate having a first and second end and at least one protrusion thereon;

cutting said cover plate to fit the elongated base member;

fastening said first end of the cover plate to the first end of the elongated base member such that said at least one protrusion is receivable within said at least one groove; and fastening a latching means to said second end of the elongated base member.

28. A method as in claim 27 further comprising:

fastening the elongated base member adjacent to a column of circuit breakers.

29. A method as in claim 27 wherein the elongated base member has a plurality of locking pin receiving grooves; the cover plate has a plurality of protrusions; the protrusions of the cover plate are spaced apart to match the grooves of the elongated base member;

said method further comprising:

hingedly fastening the cover plate to the first end of the elongated base member so that the cover plate is movable from an open position to a closed position and so that the protrusions on the cover plate are aligned with the grooves in the base member when the cover plate is in the closed position.

* * * * *